US006048658A

United States Patent [19]

Evans et al.

[11] Patent Number: 6,048,658

[45] Date of Patent: Apr. 11, 2000

[54] PROCESS FOR PREPARING ELECTROPHOTOGRAPHIC IMAGING MEMBER

[75] Inventors: Kent J. Evans, Lima; Robert F. Dunham, Walworth; Alfred H. Willnow, Ontario, all of N.Y.

[73] Assignee: Xerox Corporation, Stamford, Conn.

[21] Appl. No.: 09/408,239

[22] Filed: Sep. 29, 1999

[51] Int. Cl.[7] ..... G03G 5/043

[52] U.S. Cl. ..... 430/132; 430/129

[58] Field of Search ..... 430/132, 129

[56] References Cited

U.S. PATENT DOCUMENTS

| | | | |
|---|---|---|---|
| 4,521,457 | 6/1985 | Russell et al. | 427/286 |
| 5,213,937 | 5/1993 | Miyake | 430/130 |
| 5,476,740 | 12/1995 | Markovics et al. | 430/59 |
| 5,614,260 | 3/1997 | Darcy | 427/277 |
| 5,830,614 | 11/1998 | Pai et al. | 430/59 |
| 5,981,125 | 11/1999 | Itami | 430/134 |

*Primary Examiner*—John Goodrow

[57] ABSTRACT

A process for fabricating electrophotographic imaging members comprising providing a substrate with an exposed surface, simultaneously applying, from a coating die, two wet coatings to the surface, the wet coatings comprising a first coating in contact with the surface, the first coating comprising photoconductive particles dispersed in a solution of a film forming binder and a predetermined amount of solvent for the binder and a second coating in contact with the first coating, the second coating comprising a solution of a charge transporting small molecule and a film forming binder dissolved in a predetermined amount of solvent for the transport molecule and the binder, drying the two wet coatings to remove substantially all of the solvents to form a dry first coating having a thickness between about 0.1 micrometer and about 10 micrometers and dry second coating having a thickness between about 4 micrometers and 20 micrometers, applying at least a third coating in contact with the second coating, the third coating comprising a solution containing having a charge transporting small molecule, film forming binder and solvent substantially identical to charge transporting small molecule, film forming binder and solvent in the second coating, and drying the third coating to from a dry third coating having a thickness between about 13 micrometers and 20 micrometers.

9 Claims, 3 Drawing Sheets

FIG. 1
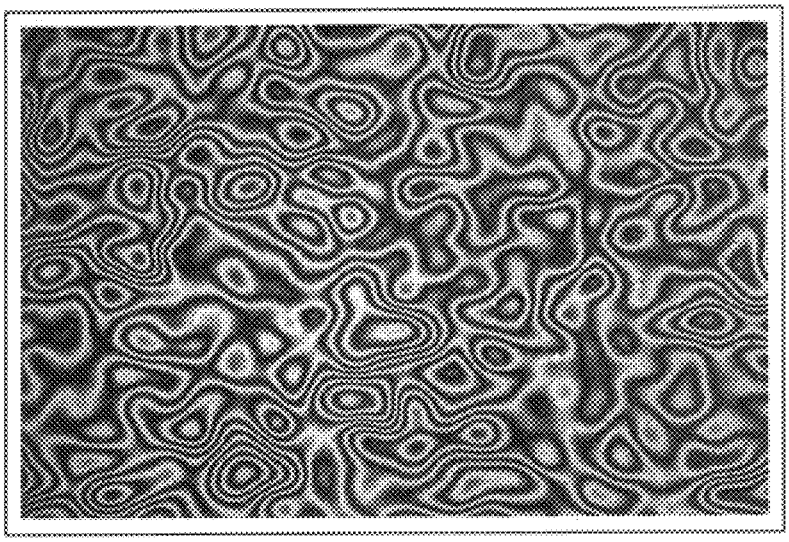
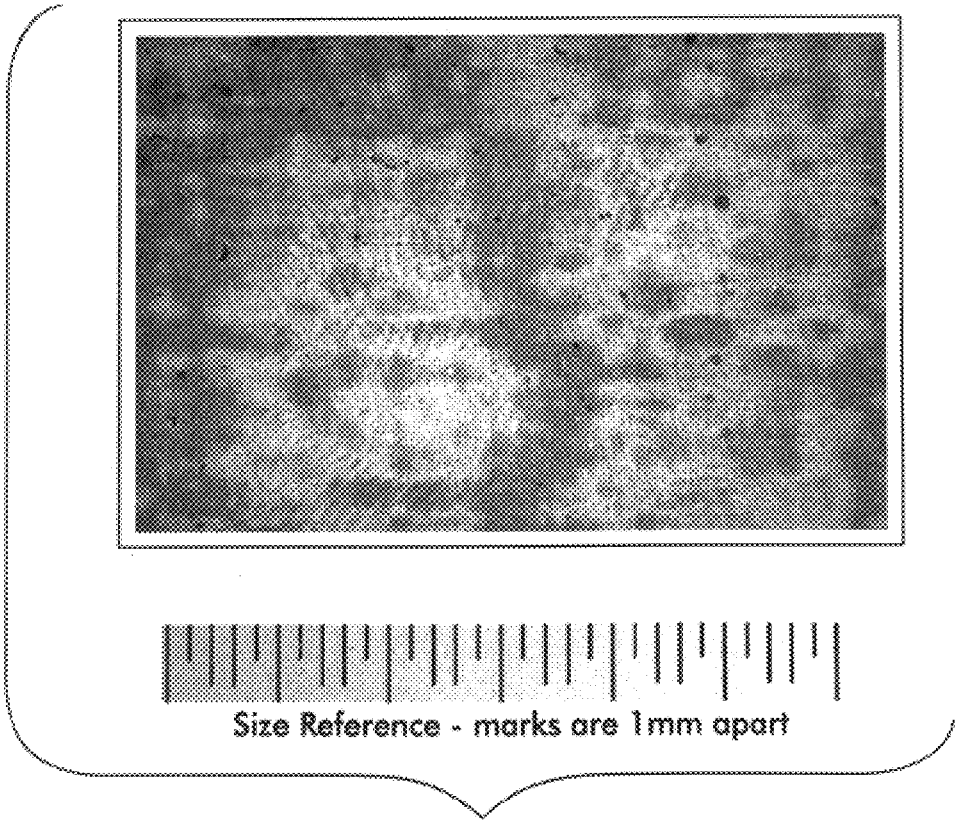
FIG. 2

FIG. 3
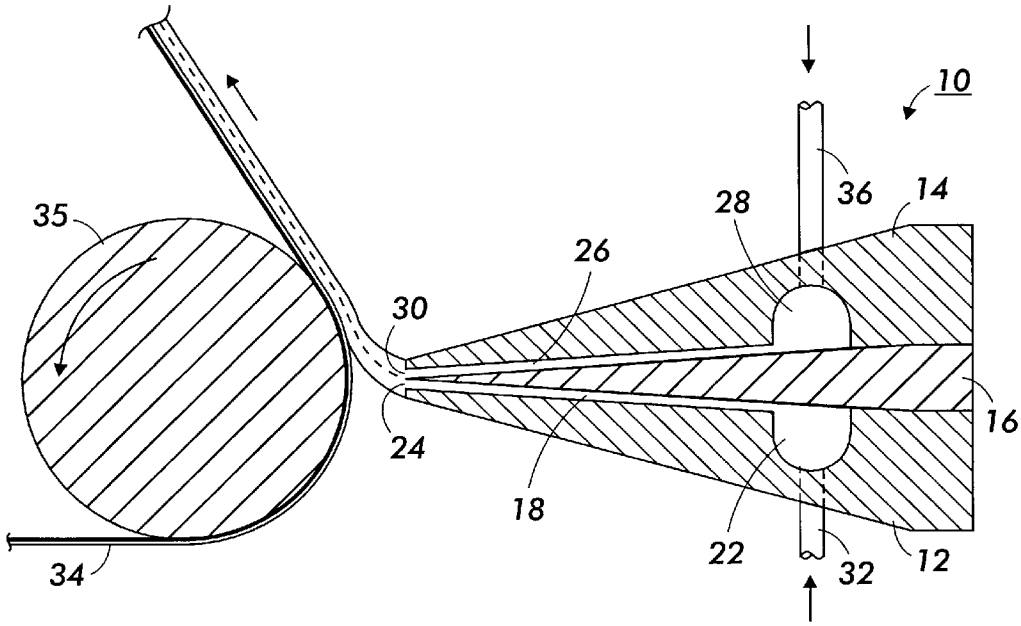
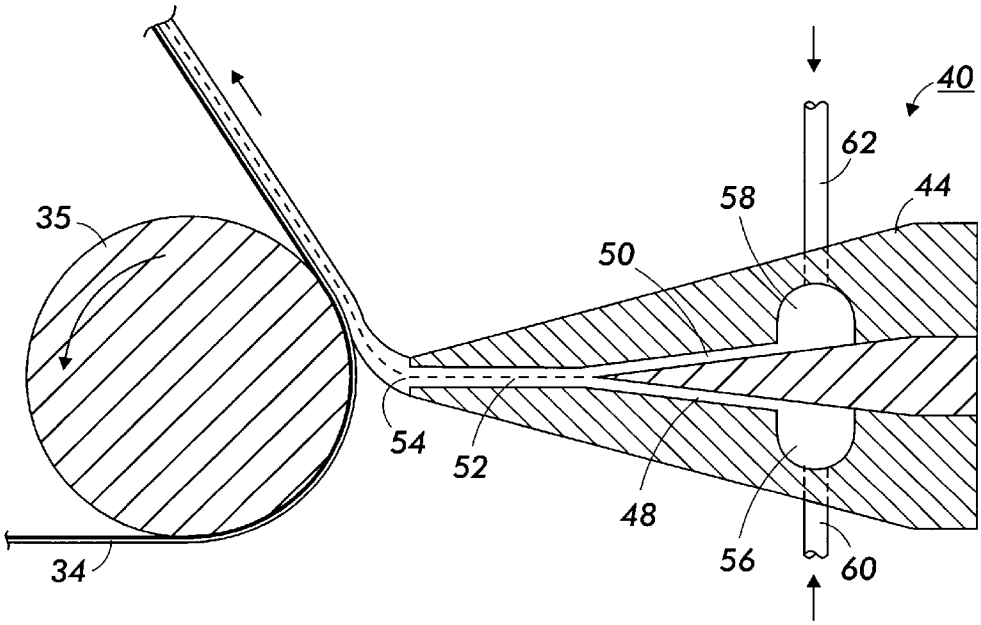
FIG. 4

FIG. 5
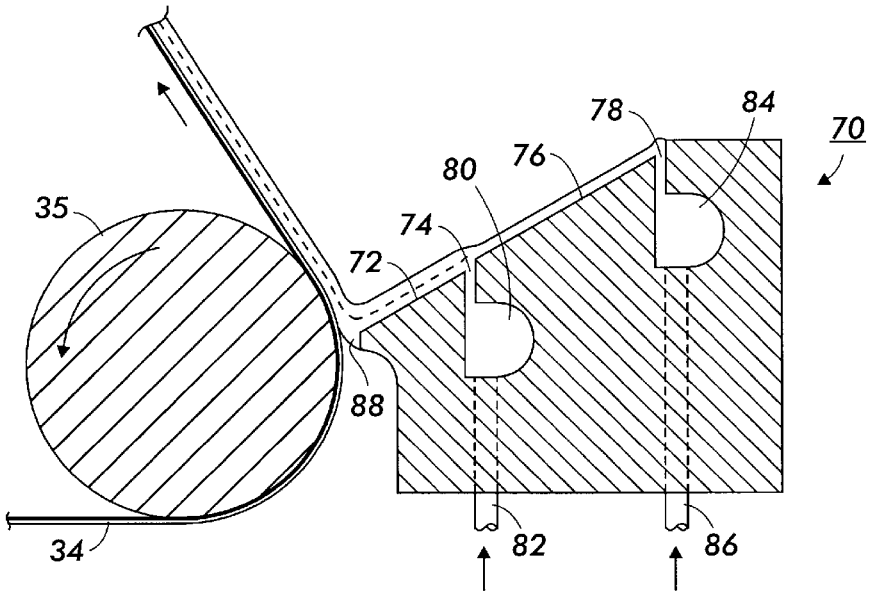
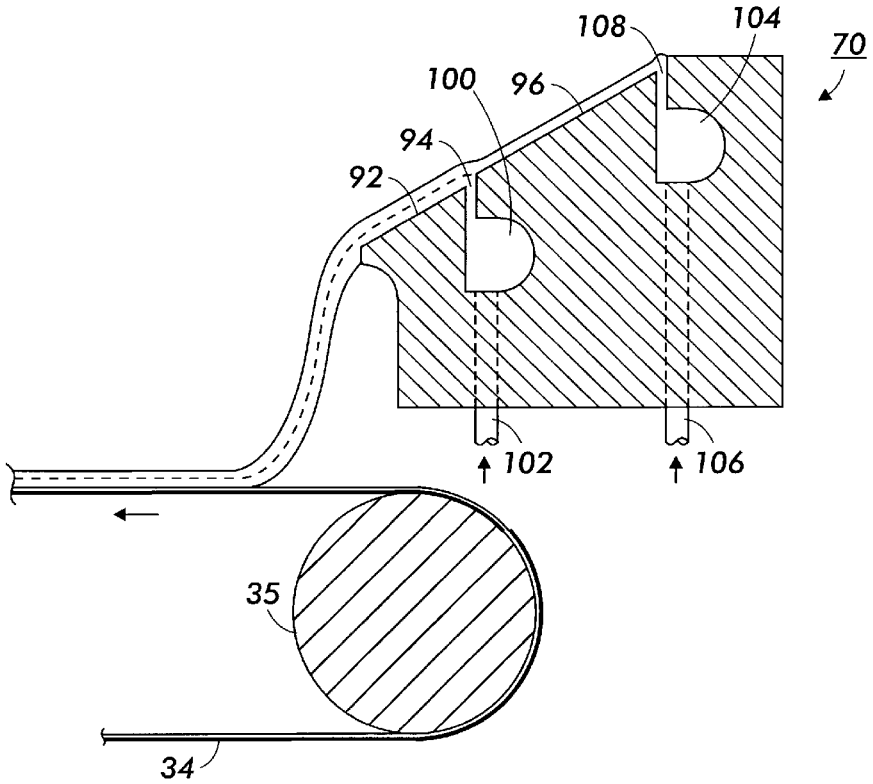
FIG. 6

PROCESS FOR PREPARING ELECTROPHOTOGRAPHIC IMAGING MEMBER

BACKGROUND OF THE INVENTION

This invention relates in general to a process for fabricating electrophotographic imaging members, and, more specifically, to the simultaneous formation of a charge generator layer and charge transport layer followed by the formation of another charge transport layer.

Typical electrophotographic imaging members comprise a photoconductive layer comprising a single layer or composite layers. One type of composite photoconductive layer used in xerography is illustrated, for example, in U.S. Pat. No. 4,265,990 which describes a photosensitive member having at least two electrically operative layers. The disclosure of this patent is incorporated herein in its entirety. One layer comprises a photoconductive layer which is capable of photogenerating holes and injecting the photogenerated holes into a contiguous charge transport layer. Generally, where the two electrically operative layers are supported on a conductive layer the photogenerating layer is sandwiched between the contiguous charge transport layer and the supporting conductive layer, the outer surface of the charge transport layer is normally charged with a uniform electrostatic charge. The photosensitive member is then exposed to a pattern of activating electromagnetic radiation such as light, which selectively dissipates the charge in illuminated areas of the photosensitive member while leaving behind an electrostatic latent image in the non-illuminated areas. This electrostatic latent image may then be developed to form a visible image by depositing finely divided electrostatic toner particles on the surface of the photosensitive member. The resulting visible toner image can be transferred to a suitable receiving material such as paper. This imaging process may be repeated many times with reusable photosensitive members.

As more advanced, complex, highly sophisticated, electrophotographic copiers, duplicators and printers were developed, greater demands were placed on the photoreceptor to meet stringent requirements for the production of high quality images. For example, the numerous layers found in many modern photoconductive imaging members must be uniform, free of defects, adhere well to adjacent layers, and exhibit predictable electrical characteristics within narrow operating limits to provide excellent toner images over many thousands of cycles. One type of multilayered photoreceptor that has been employed as a drum or belt in electrophotographic imaging systems comprises a substrate, a conductive layer, a charge blocking layer, an adhesive layer, a charge generating layer, and a charge transport layer. This photoreceptor may also comprise additional layers such as an overcoating layer. Although excellent toner images may be obtained with multilayered photoreceptors, it has been found that the numerous layers limit the versatility of the multilayered photoreceptor. For example, when a thick, e.g., 29 micrometers, layer of a charge transport layer is formed in a single pass a raindrop pattern to form on the exposed imaging surface of the final dried photoreceptor.

This raindrop phenomenon is a print defect caused by the coating thickness variations (high frequency) in photoreceptors having a relatively thick (e.g., 29 micrometers) charge transport layer. More specifically, the expression "raindrop", as employed herein, is defined as a high frequency variation in the transport layer thickness. The period of variation is in the 0.1 cm to 2.5 cm range. The amplitude of variation is between 0.5 micrometer and 1.5 micrometers. The variation can also be defined on a per unit area basis. Raindrop can occur with the transport layer thickness variation is in the range of 0.5 to 1.5 microns per sq. cm. The morphological structure of raindrop is variable depends on where and how the device is coated. The structure can be periodic or random, symmetrical or oriented.

INFORMATION DISCLOSURE STATEMENT

U.S. Pat. No. 5,476,740 to Markovics, et al., issued Dec. 19, 1995—An electrophotographic imaging member is disclosed which includes a charge generating layer, a charge transport layer and an interphase region. The interphase region includes a mixture of a charge generating material and a charge transport material, in intimate contact, and may be formed, for example, by applying a charge transport material prior to drying or curing an underlying charge generating layer to produce an interphase structure that is different from the charge generating and charge transport layers.

U.S. Pat. No. 5,213,937 to Miyake, issued May 25, 1993—A process of preparing electrophotographic photoreceptor aluminum drums is disclosed having coated layers with a constant thickness and properties is disclosed. After a carrier generation layer being dip coated, a process of conveyance is followed at a temperature same as that of the coating material.

U.S. Pat. No. 5,830,614 to Pai et al., issued Nov. 3, 1998—A charge transport dual layer is disclosed for use in a multilayer photoreceptor comprising a support layer, a charge generating layer and a charge transport dual layer including a first transport layer containing a charge-transporting polymer, and a second transport layer containing a charge-transporting polymer having a lower weight percent of charge transporting segments than the charge-transporting polymer in the first transport layer. This structure has greater resistance to corona effects and provides for a longer service life. The charge-transporting polymers preferably comprise polymeric arylamine compounds U.S. Pat. No. 4,521,457 to Russel et al., issued Jun. 4, 1985—At least one ribbon-like stream of a first coating composition adjacent to and in edge contact with at least one second ribbon-like stream of a second coating composition are deposited on the surface of a support member by establishing relative motion between the surface of the support member and the ribbon-like streams, simultaneously constraining and forming the ribbon-like streams parallel to and closely spaced from each other, contacting adjacent edges of the ribbon-like streams prior to applying the ribbon-like streams to the surface of the support member and thereafter applying the ribbon-like streams to the surface of the support member.

U.S. Pat. No. 5,614,260 to PJ. J. Darcy, issued Mar. 25, 1997—A process is disclosed for applying to a surface of a support member at least one ribbon-like stream of a first coating composition side-by-side with at least one ribbon-like stream of a second coating composition comprising providing an extrusion die source for the ribbon-like stream of the first coating composition, providing a slide die source for the ribbon-like stream of the second coating composition, establishing relative motion between the surface of the support member and the source of the ribbon-like streams, simultaneously and continuously applying the ribbon-like streams to the surface of the support member whereby the ribbon-like streams extend in the direction of relative movement of the surface of the support member and the sources of the ribbon-like streams to form a continuous unitary layer having a boundary between the side-by-side ribbon-like streams on the surface of the support member and drying the continuous unitary layer to form a dried coating of the first coating composition side-by-side with a dried coating of the second coating composition. This process may be carried out with apparatus comprising an extrusion die attached to and supporting a slide die, the extrusion die being adapted to applying to a surface of a support member at least one ribbon-like stream of a first coating composition and the slide die being adapted to apply to the surface a ribbon-like stream of a second coating composition side-by-side to and in edge contact with the ribbon-like stream of the first coating composition.

While the above mentioned electrophotographic imaging members may be suitable for their intended purposes, there continues to be a need for improved imaging members, particularly for methods for fabricating multilayered electrophotographic imaging members in flexible belts.

CROSS REFERENCE TO COPENDING APPLICATIONS

U.S. application Ser. No. 09/408,346, entitled "Process For Fabricating Electrophotographic Imaging Member" filed concurrently herewith in the names of K. J. Evans et al., A process is disclosed for fabricating electrophotographic imaging members including providing an imaging member including a substrate coated with a charge generating layer having an exposed surface, applying a first solution including a charge transporting small molecule and film forming binder to the exposed surface to form a first charge transporting layer having a thickness of greater than about 13 micrometers and less than about 20 micrometers in the dried state and an exposed surface, and applying at least a second solution having a composition substantially identical to the first solution to the exposed surface of the first charge transporting layer to form at least a second continuous charge transporting layer, the at least second charge transport layer having a thickness in a dried state less than about 20 micrometers in the dried state, the at least second charge transport layer, and any subsequently applied solution having a composition substantially identical to the first solution.

The formation of relatively thick charge transport layers by applying two thinner coatings on a previously formed charge generator layer greatly increases coating thickness uniformity and avoids "raindrop" defects. However, this approach requires two coating passes instead of one to form a charge transport layer and results in an incremental product cost due to the required extra coating pass and reduced productivity.

With some charge transport layer coating solutions, a charge transport layer thinner than about 14 to 14.5 micrometers (when measured in the dry state) results in a severe defect known as ribbing instability. This instability leads to dried coatings which have the appearance of individual lines of coating roughly 0.25 cm–1 cm in width separated by uncoated lines also roughly 0.25 cm–1 cm in width.

BRIEF SUMMARY OF THE INVENTION

It is, therefore, an object of the present invention to provide an improved process for fabricating an electrophotographic imaging member.

It is another object of the present invention to provide a more efficient process for fabricating an improved electrophotographic imaging member.

It is yet another object of the present invention to provide an improved process for achieving coating uniformity in a charge transport layer.

It is still another object of the present invention to provide an improved process for eliminating raindrop defects in charge transport layers.

It is another object of the present invention to provide an improved process for reducing curl in electrophotographic imaging members.

It is yet another object of the present invention to provide an improved process for forming uniform charge transport layers greater than 20 micrometers in thickness.

The foregoing objects and others are accomplished in accordance with this invention by providing a process for fabricating electrophotographic imaging members comprising providing a substrate with an exposed surface, simultaneously applying, from a coating die, two wet coatings to the surface, the wet coatings comprising a first coating in contact with the surface, the first coating comprising photoconductive particles dispersed in a solution of a film forming binder and a predetermined amount of solvent for the binder and a second coating in contact with the first coating, the second coating comprising a solution of a charge transporting small molecule and a film forming binder dissolved in a predetermined amount of solvent for the transport molecule and the binder, drying the two wet coatings to remove substantially all of the solvents to form a dry first coating having a thickness between about 0.1 micrometer and about 10 micrometers and dry second coating having a thickness between about 4 micrometers and 20 micrometers, applying at least a third coating in contact with the second coating, the third coating comprising a solution containing having a charge transporting small molecule, film forming binder and solvent substantially identical to charge transporting small molecule, film forming binder and solvent in the second coating, and drying the third coating to from a dry third coating having a thickness between about 13 micrometers and 20 micrometers.

In order to achieve the uniformity required to eliminate the raindrop defect, the first transport layer and second transport layer thicknesses and the transport coating solution must meet certain requirements. More specifically, the first application of transport layer solution must be such that the dried state thickness is less about 20 micrometers. In addition, experience has shown that the minimum thickness of the first transport layer solution must be greater than about 4 micrometers in the dried state to get a continuous film when simultaneously applied with a charge generator layer dispersion. The expression "dried state" as employed herein is defined as a residual solvent content of less that about 10 percent by weight, based on the total weight of the dried layer. Since the thickness of freshly applied liquid layers can vary depending upon the solids concentration even though these liquid layers of different solids concentration can form layers in the "dried state" having identical thicknesses, the expression "dried state" is employed as a common standard to more adequately describe the invention.

The second application must also be such the dried state thickness is less about 20 micrometers. In addition, experience has shown that the minimum thickness of the second solution must also be greater than about 13 micrometers in the dried state to get a continuous film.

The total solution solids for the first transport layer should be greater than about 10 weight percent for the combined loading of small charge transport molecule and film forming binder. The solution viscosity should be greater than about 70 cp.

The total solution solids of the second transport layer should be greater than about 13 weight percent for the combined loading of small charge transport molecule and film forming binder. The solution viscosity should be greater than about 400 cp.

Mathematically the requirements can be expressed as follows:

$$\delta = L1 + L2,$$

Where:

$$4 \sim < L1$$

and:

$$13 \sim < L2 \sim < 20$$

and:

δ, L1, and L2 are dried layer thickness in micrometers.

Generally, photoreceptors comprise a supporting substrate having an electrically conductive surface layer, an optional charge blocking layer on the electrically conductive surface, an optional adhesive layer, a charge generating layer on the blocking layer and a transport layer on the charge generating layer.

The supporting substrate may be opaque or substantially transparent and may be fabricated from various materials having the requisite mechanical properties. The supporting substrate may comprise electrically non-conductive or conductive, inorganic or organic composition materials. The supporting substrate may be rigid or flexible and may have a number of different configurations such as, for example, a cylinder, sheet, a scroll, an endless flexible belt, or the like. Preferably, the supporting substrate is in the form of an endless flexible belt and comprises a commercially available biaxially oriented polyester known as Mylar® available from E.I. du Pont de Nemours & Co. or Melinex® available from ICI. Exemplary electrically non-conducing materials known for this purpose include polyesters, polycarbonates, polyamides, polyurethanes, and the like.

The average thickness of the supporting substrate depends on numerous factors, including economic considerations. A flexible belt may be of substantial thickness, for example, over 200 micrometers, or have a minimum thickness less than 50 micrometers, provided there are no adverse affects on the final multilayer photoreceptor device. In one flexible belt embodiment, the average thickness of the support layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers.

The electrically conductive surface layer may vary in average thickness over substantially wide ranges depending on the optical transparency and flexibility desired for the multilayer photoreceptor. Accordingly, when a flexible multilayer photoreceptor is desired, the thickness of the electrically conductive surface layer may be between about 20 Angstrom units to about 750 Angstrom units, and more preferably from about 50 Angstrom units to about 200 Angstrom units for a preferred combination of electrical conductivity, flexibility and light transmission. The electrically conductive surface layer may be a metal layer formed, for example, on the support layer by a coating technique, such as a vacuum deposition. Typical metals employed for this purpose include aluminum, zirconium, niobium, tantalum, vanadium and hafnium, titanium, nickel, stainless steel, chromium, tungsten, molybdenum, and the like. Useful metal alloys may contain two or more metals such as zirconium, niobium, tantalum, vanadium and hafnium, titanium, nickel, stainless steel, chromium, tungsten, molybdenum, and the like. Regardless of the technique employed to form the metal layer, a thin layer of metal oxide may form on the outer surface of most metals upon exposure to air. Thus, when other layers overlying a (metal) electrically conductive surface layer are described as "contiguous" layers, it is intended that these overlying contiguous layers may, in fact, contact a thin metal oxide layer that has formed on the outer surface of the oxidizable metal layer. An average thickness of between about 30 Angstrom units and about 60 Angstrom units is preferred for the thin metal oxide layers for improved electrical behavior. Generally, for rear erase exposure, a conductive layer light transparency of at least about 15 percent is desirable. The light transparency allows the design of machines employing erase from the rear. The electrically conductive surface layer need not be limited to metals. Other examples of conductive layers may be combinations of materials such as conductive indium-tin oxide as a transparent layer for light having a wavelength between about 4000 Angstroms and about 7000 Angstroms or a conductive carbon black dispersed in a plastic binder as an opaque conductive layer.

After deposition of the electrically conductive surface layer, an optional blocking layer may be applied thereto. Generally, electron blocking layers for positively charged photoreceptors allow holes from the imaging surface of the photoreceptor to migrate toward the conductive layer. For use in negatively charged systems any suitable blocking layer capable of forming an electronic barrier to holes between the adjacent multilayer photoreceptor layers and the underlying conductive layer may be utilized. The blocking layer may be organic or inorganic and may be deposited by any suitable technique. For example, if the blocking layer is soluble in a solvent, it may be applied as a solution and the solvent can subsequently be removed by any conventional method such as by drying. Typical blocking layers include polyvinylbutyral, organosilanes, epoxy resins, polyesters, polyamides, polyurethanes, pyroxyline vinylidene chloride resin, silicone resins, fluorocarbon resins and the like containing an organo-metallic salt. Other blocking layer materials include nitrogen-containing siloxanes or nitrogen-containing titanium compounds such as trimethoxysilyl propylene diamine, hydrolyzed trimethoxysilylpropylethylene diamine, N-beta-(aminoethyl)-gamma-aminopropyltrimethoxy silane, isopropyl-4-aminobenzene sulfonyl, di(dodecylbenzene sulfonyl) titanate, isopropyl-di(4-aminobenzoyl)isostearoyl titanate, isopropyl-tri(N-ethylamino-ethylamino) titanate, isopropyl trianthranil titanate, isopropyl-tri-(N,N-dimethylethylamino) titanate, titanium-4-amino benzene sulfonatoxyacetate, titanium 4-aminobenzoate-isostearate-oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyldiethoxy silane, as disclosed in U.S. Pat. Nos. 4,291,110, 4,338,387, 4,286,033 and 4,291,110, the entire disclosures of these patents being incorporated herein by reference. The blocking layer may comprise a reaction product between a hydrolyzed silane and a thin metal oxide layer formed on the outer surface of an oxidizable metal electrically conductive surface.

The blocking layer should be continuous and usually has an average thickness of less than about 5000 Angstrom units. A blocking layer of between about 50 Angstrom units and about 3000 Angstrom units is preferred because charge neutralization after light exposure of the multilayer photoreceptor is facilitated and improved electrical performance is achieved. The blocking layer may be applied by a suitable technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by techniques such as by vacuum, heating and the like. Generally, a weight ratio of blocking layer material and solvent of between about 0.05:100 and about 0.5:100 is satisfactory for spray coating. A typical siloxane coating is described in U.S. Pat. No. 4,464,450, the entire disclosure thereof being incorporated herein by reference.

If desired, an optional adhesive layer may be applied to the hole blocking layer or conductive surface. Typical adhesive layers include a polyester resin such as Vitel PE-100®, Vitel PE-200®, Vitel PE-200D®, and Vitel PE-222®, all available from Goodyear Tire and Rubber Co., duPont 49,000 polyester, polyvinyl butyral, and the like. When an adhesive layer is employed, it should be continuous and, preferably, have an average dry thickness between about 200 Angstrom units and about 900 Angstrom units and more preferably between about 400 Angstrom units and about 700 Angstrom units. Any suitable solvent or solvent mixtures may be employed to form a coating solution of the adhesive layer material. Typical solvents include tetrahydrofuran, toluene, methylene chloride, cyclohexanone, and mixtures thereof. Generally, for example, to achieve a continuous adhesive layer dry thickness of about 900 Angstroms or less by gravure coating techniques, the preferred solids concentration is about 2 percent to about 5 percent by weight based on the total weight of the coating mixture of resin and solvent. However, any suitable technique may be utilized to mix and thereafter apply the adhesive layer coating mixture to the charge blocking layer. Typical application techniques include spraying, dip coating, roll coating, wire wound rod coating, and the like. Drying of the deposited coating may be effected by a suitable technique such as oven drying, infra red radiation drying, air drying and the like.

A charge generating layer is applied to the blocking layer or adhesive layer, if either are employed. Since the generating layer may be applied to an uncoated or coated substrate, the object being coated by the generating layer is, for the sake of convenience, referred to herein as a "substrate with an exposed surface". The generating layer is simultaneously applied with the first of a plurality of charge transport layers as described herein. Examples of charge generating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine described in U.S. Pat. No. 3,357,989, metal phthalocyanines such as vanadyl phthalocyanine, titanyl phthalocyanines and copper phthalocyanine, quinacridones available from DuPont under the trade name Monastral Red®, Monastral Violet® and Monastral Red Y®. Vat Orange 1® and Vat Orange 3® are trade names for dibromoanthrone pigments, benzimidazole perylene, substituted 3,4-diaminotriazines disclosed in U.S. Pat. No. 3,442,781, polynuclear aromatic quinones available from Allied Chemical Corporation under the tradename Indofast Double Scarlet®, Indofast Violet Lake B®. Indofast Brilliant Scarlet® and Indofast Orange®, and the like dispersed in a film forming polymeric binder. Benzimidazole perylene compositions are well known and described, for example, in U.S. Pat. No. 4,587,189. Multiphotogenerating layer compositions may be utilized wherein an additional photoconductive layer may enhance or reduce the properties of the charge generating layer. Examples of this type of configuration are described in U.S. Pat. No. 4,415,639. Other suitable charge generating materials known in the art may also be utilized, if desired. Charge generating binder layers comprising particles or layers including a photoconductive material such as vanadyl phthalocyanine, titanyl phthalocyanines, metal-free phthalocyanine, benzimidazole perylene, amorphous selenium, trigonal selenium, selenium alloys such as selenium-tellurium, selenium-tellurium-arsenic, selenium arsenide and the like, and mixtures thereof, are especially preferred because of their sensitivity to white light. Vanadyl phthalocyanine, titanyl phthalocyanines, metal free phthalocyanine and tellurium alloys are also preferred because these materials provide the additional benefit of being sensitive to infra-red light.

Numerous inactive resin materials may be employed in the charge generating binder layer including those described, for example, in U.S. Pat. No. 3,121,006. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like. These polymers may be block, random or alternating copolymers.

An active transporting polymer containing charge transporting segments may also be employed as the binder in the charge generating layer. These polymers are particularly useful where the concentration of carrier-generating pigment particles is low and the average thickness of the carrier-generating layer is substantially thicker than about 0.7 micrometer. The active polymer commonly used as a binder is polyvinylcarbazole whose function is to transport carriers which would otherwise be trapped in the layer.

Electrically active polymeric arylamine compounds can be employed in the charge generating layer to replace the polyvinylcarbazole binder or another active or inactive binder. Part or all of the active resin materials to be employed in the charge generating layer may be replaced by electrically active polymeric arylamine compounds.

The photogenerating composition or pigment is present in the resinous binder composition in various amounts, generally, however, from about 5 percent by volume to about 90 percent by volume of the photogenerating pigment is dispersed in about 95 percent by volume to about 10 percent by volume of the resinous binder, and preferably from about 20 percent by volume to about 30 percent by volume of the photogenerating pigment is dispersed in about 80 percent by volume to about 70 percent by volume of the resinous binder composition. In one embodiment about 8 percent by volume of the photogenerating pigment is dispersed in about 92 percent by volume of the resinous binder composition.

The liquid extruded charge generating layer coating should be continuous and sufficiently thick to provide the desired predetermined dried layer thicknesses. The charge generating layer containing photoconductive compositions and/or pigments and the resinous binder material generally ranges in average dried thickness from about 0.1 micrometer to about 10 micrometers, and preferably has an average dried thickness from about 0.3 micrometer to about 3 micrometers. The charge generating layer thickness is related to binder content. Higher binder content compositions generally require thicker layers for photogeneration. Thicknesses outside these ranges can be selected providing the objectives of the present invention are achieved.

With the simultaneous extrusion process of this invention, a charge generation layer can be formed which is thinner than charge generation layers that are formed by conventional extrusion techniques. In addition attempts to use conventional techniques for the coating of charge generating layers involving Newtonian dispersions have a viscosity of less than about 30 centiposes and drying by conventional techniques can encounter convection cell problems, light spots, roll patterns, run back (in dryers), and drying patterns. However, with the simultaneous coating of a generating layer and first transport layer of this invention, one can coat Newtonian dispersions having a viscosity of less than about 70 centipoises and avoid these problems.

Any suitable simultaneous coating technique may be utilized to apply the generating layer. Typical coating techniques include, for example, multi- or dual-slot, co-extrusion single slot, multilayer slide, curtain coating, multilayer curtain coating and the like. For simultaneously applying the generating layer and the first transport layer, the coating technique for applying the generating layer may be same as or different from the coating technique used for applying the first transport layer. The simultaneously deposited coatings result in the generating layer being sandwiched between the first transport layer and the substrate. The expression "simultaneously" as employed herein is defined as applying liquid coatings which are contacted with each other prior to or simultaneously with contact with the substrate. At point of contact with the substrate, the liquids are qualitatively viewed as sharing an internal liquid-liquid interface. This interface can either reflect a true separation between two phases or simply a region of miscibility between the two layers. The expression "liquid coatings" as employed herein is defined as coatings in the flowable liquid state at the time of application. For the liquid generator layer dispersion, the liquid solvent is a solvent for the film forming binder, but is normally not a solvent for the dispersed photoconductive particles. The solvent used for both layers must either be miscible or capable of inter-diffusing between the layers of the liquid state, at point of application. In the dry state, there are no miscibility or inter-diffusability requirements. Each layer can be, and often is, a discrete immiscible phase.

Since the charge generating layer is not separately dried prior to application of the first charge transport layer, a separate drying step and lengthy processing path are eliminated. Moreover, the simultaneous coating of the generator layer and first transport layer can be accomplished in a very small area thereby eliminating a separate coating and drying section for only the generating layer.

The active charge transport layer may comprise any suitable non-polymeric small molecule charge transport material capable of supporting the injection of photogenerated holes and electrons from the charge generating layer and allowing the transport of these holes or electrons through the charge transport layer to selectively discharge the surface charge. The active charge transport layer not only serves to transport holes or electrons, but also protects the charge generator layer from abrasion or chemical attack and therefor extends the operating life of the photoreceptor imaging member. Thus, the active charge transport layer is a substantially non-photoconductive material which supports the injection of photogenerated holes or electrons from the generation layer. The active transport layer is normally transparent when exposure is effected through the active layer to ensure that most of the incident radiation is utilized by the underlying charge generator layer for efficient photogeneration. The charge transport layer in conjunction with the generation layer in the instant invention is a material which is an insulator to the extent that an electrostatic charge placed on the transport layer is not conducted in the absence of activating illumination. For reasons of convenience, discussion will refer to charge carriers or hole transport. However, transport of electrons is also contemplated as within the scope of this invention.

Any suitable soluble non-polymeric small molecule transport material may be employed in the charge transport layer coating mixture. This small molecule transport material is dispersed in an electrically inactive polymeric film forming materials to make these materials electrically active. These non-polymeric activating materials are added to film forming polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Any suitable non-polymeric small molecule charge transport material, which is soluble or dispersible on a molecular scale in a film forming binder, may be utilized in the continuous phase of the charge transporting layer of this invention. The charge transport molecule should be capable of transporting charge carriers injected by the charge injection enabling particles in an applied electric field. The charge transport molecules may be hole transport molecules or electron transport molecules. Typical charge transporting materials include the following:

Diamine transport molecules of the types described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(alkylphenyl)-[1,1'-biphenyl]-4,4'-diamine wherein the alkyl is, for example, methyl, ethyl, propyl, n-butyl, etc. such as N,N'-diphenyl-N,N'-bis(3"-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'- biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944.

Hydrazone including, for example, p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example in U.S. Pat. No. 4,385,106, 4,338,388, 4,387,147, 4,399,208, 4,399,207.

Still another charge transport molecule is a carbazole phenyl hydrazone. Typical examples of carbazole phenyl hydrazone transport molecules include 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989.

The charge transport layer forming solution preferably comprises an aromatic amine compound as the activating compound. An especially preferred charge transport layer composition employed to fabricate the two or more charge transport layer coatings of this invention preferably comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, 1,1'-biphenyl)-4,4'-diamine, and the like dispersed in an inactive resin binder.

Examples of electrophotographic imaging members having at least two electrically operative layers, including a charge generator layer and diamine containing transport layer, are disclosed in U.S. Pat. Nos. 4,265,990, 4,233,384, 4,306,008, 4,299,897 and 4,439,507, the entire disclosures thereof being incorporated herein by reference.

Any suitable soluble inactive film forming binder may be utilized in the charge transporting layer coating mixture. The inactive polymeric film forming binder may be soluble, for example, in methylene chloride, chlorobenzene, tetrahydrofuran, toluene or other suitable solvent. Typical inactive polymeric film forming binders include polycarbonate resin, polyester, polyarylate, polyacrylate, polyether, polysulfone, and the like. Molecular weights can vary, for example, from about 20,000 to about 1,500,000. An especially preferred film forming polymer for charge transport layer is polycarbonates. Typical film forming polymer polycarbonates include, for example, bisphenol polycarbonate, poly(4,4'-isopropylidene diphenyl carbonate), 4,4'-cyclohexylidene diphenyl polycarbonate, bisphenol A type polycarbonate of 4,4'-isopropylidene (commercially available form Bayer AG as Makrolon), poly(4,4'-diphenyl-1,1'-cyclohexane carbonate) and the like. The polycarbonate resins typically employed for charge transport layer applications have a weight average molecular weight from about 70,000 to about 150,000.

Any suitable extrusion coating technique may be employed to form any of the charge transport layer coatings. Typical extrusion techniques include, for example, multi-slot, co-extrusion single slot, slide, curtain coating, and the like.

The liquid extruded charge transport layers should be continuous and sufficiently thick to provide the desired predetermined dried layer thicknesses. The maximum wet thickness of the deposited layer depends upon the solids concentration of the coating mixture being extruded. The expression "solids", as employed herein refers to the materials that are normally solids in the pure state at room temperature. In other words, solids are generally those materials in the coating solution that are not solvents. The relative proportion of solvent to solids in the coating solution varies depending upon the specific coating materials used, type of coating applicator selected, and relative speed between the applicator and the object being coated.

Preferably, the solids concentration range is greater than about 13 percent total solids, based the weight of the coating solution. The maximum solids concentration is determined by the combined solubility of the small molecule with film forming binder components in the solvent of choice. For example in methylene chloride, this limit is in the range of about 18 percent to about 20 percent total solids. Moreover, it is preferred that the viscosity of the coating solution is between about 400 and about 1500 centipoises for satisfactory flowability and coatability. Highly dilute coating solutions of low viscosity can cause raindrop patterns to form.

Generally, in the sequential single layer charge transport layer coating process, each extruded layer should have a thickness of greater than about 13 micrometers and less than about 20 micrometers in the dried state. When the first charge transport layer is coated by the simultaneous application over the charge generation layer, the subject of this invention, the minimum achievable thickness is about 4 micrometers on a dry basis. The application of a second singular charge transport layer is still constrained to between about 13 and about 20 microns on a dry basis.

In singular coating, when the extruded charge transport layer has a thickness greater than about 20 micrometers in the dried state, an undesirable raindrop pattern appears in the final toner images formed during image cycling. When the extruded layer has a thickness less than about 13 micrometers in the dried state, bead breaks occur during the coating process.

In simultaneous extruded coating with the charge generation layer on the bottom, then the top charge transport layer can be coated as thin as 4 micrometers on a dry basis. The simultaneously coated transport layer is still subject to the 20 micrometers dry state limit as the singular coating due to raindrop formation.

When only two charge transport layers are deposited, the first simultaneously coated layer preferably has a thickness in the dried state of greater than about 4 micrometers and less than about 20 micrometers. The second layer preferably has a thickness in the dried state of greater than about 13 micrometers and less than about 20 micrometers. The total combined thickness of both extruded charge transport layers in the dried state should be greater than about 20 micrometers and less than about 40 micrometers.

When three charge transport layers are deposited, the first, simultaneously coated layer preferably has a thickness in the dried state of greater than about 4 micrometers and less than about 20 micrometers. The second and third layers each preferably have a thickness in the dried state of greater than about 13 micrometers and less than about 20 micrometers and the total combined thickness of all three extruded charge transport layers in the dried state should be greater than about 30 micrometers and less than about 60 micrometers.

When four charge transport layers are deposited, the first, simultaneously coated layer preferably has a thickness in the dried state of greater than about 4 micrometers and less than about 20 micrometers. The second, third and forth layers each preferably have a thickness in the dried state of greater than about 13 micrometers and less than about 20 micrometers and the total combined thickness of all three extruded charge transport layers in the dried state should be greater than about 43 micrometers and less than about 80 micrometers.

Drying of each deposited charge transport layer coating may be effected by any suitable conventional technique such as oven drying, infra red radiation drying, air drying and the like. The simultaneously coated charge generation layer and first transport layer are dried as a combined package. Thereafter, any singularly coated transport layers first dried after each application, prior to coating any additional layers. In general, the ratio of the thickness of the final dried combination of charge transport layers to the charge generator layer after drying is preferably maintained from about 2:1 to 8:1.

If desired, after formation of the charge transport layers, the resulting electrophotographic imaging member may optionally be coated with any suitable overcoating layer.

Other layers such as conventional ground strips comprising, for example, conductive particles dispersed in a film-forming binder may be applied to one edge of the multilayer photoreceptor in contact with the conductive surface, blocking layer, adhesive layer or charge generating layer.

In some cases a back coating may be applied to the side opposite the multilayer photoreceptor to provide flatness and/or abrasion resistance. This backcoating layer may comprise an organic polymer or inorganic polymer that is electrically insulating or slightly semi-conductive.

The multilayer photoreceptor of the present invention may be employed in any suitable and conventional electrophotographic imaging process which utilizes charging prior to imagewise exposure to activating electromagnetic radiation. Conventional positive or reversal development techniques may be employed to form a marking material image on the imaging surface of the electrophotographic imaging member of this invention.

BRIEF DESCRIPTION OF THE DRAWINGS

A more complete understanding of the process of the present invention can be obtained by reference to the accompanying drawings wherein:

FIG. 1 illustrates a typical monochromatic interference image of a 29 micrometer thick transport layer coated as single wet layer of a control photoreceptor.

FIG. 2 illustrates a typical monochromatic interference image of a 29 micrometer thick transport layer obtained by simultaneously coating a 0.6 micrometer thick generator (dried thickness) and a 10 micrometer transport layer (dried thickness) followed by formation of a second, 19 micrometer thick transport layer to yield the 29 micrometer thick transport layer.

FIG. 3 illustrates a schematic cross sectional view of a dual slot coating applicator.

FIG. 4 illustrates a schematic cross sectional view of a co-extrusion coating applicator.

FIG. 5 illustrates a schematic cross sectional view of a multilayer slide coating applicator.

FIG. 6 illustrates a schematic cross sectional view of a multilayer curtain coating applicator.

FIGS. 1 and 2 are referred to in greater detail in the following Working Examples.

With reference to FIG. 3, a dual slot coating applicator assembly 10 is illustrated. Slot coating dies are well known and described, for example, in U.S. Pat. Nos. 4,521,457 and 5,614,260, the entire disclosures thereof being incorporated herein by reference. Applicator assembly 10 comprises a lower lip 12, an upper lip 14, each being spaced from a common divider lip 16 to form flat narrow passageways 18 and 20. Flat narrow passageway 18 leads from manifold 22 to exit slot 24. Similarly, flat narrow passageway 26 leads from manifold 28 to exit slot 30. A charge generating layer coating dispersion is fed into manifold 22 through feed pipe 32 and is extruded as a ribbon-like stream in through passageway 18 and out exit slot 24 onto substrate 34. Substrate 34 is supported by rotatable roll 35. Similarly, a charge transport layer coating solution is fed into manifold 28 through feed pipe 36 and is extruded as a ribbon-like stream through passageway 26 and out exit slot 30 toward substrate 34. As shown in FIG. 3, the ribbon like streams of liquid charge generating layer coating material and charge transport layer coating material contact each other and are deposited simultaneously on substrate 34. The width, thickness, and the like of the ribbon-like streams can be varied in accordance with factors such as the viscosity of the coating composition, thickness of the coating desired, and width of the substrate 34 on which the coating compositions are applied, and the like. End dams (not shown) are secured to the ends of lower lip 12, upper lip 14, and common divider lip 16 of applicator assembly 10 to confine the coating compositions within the manifolds and passageways as the coating compositions travel from feed pipes to manifolds to the exit slots. The length of the passageways should be sufficiently long to ensure laminar flow. Control of the distance of exit slots 24 and 30 from substrate 34 enables the coating compositions to bridge the gap between exit slots 24 and 30 and substrate 34 depending upon the viscosity and rate of flow of the coating compositions and the relative rate movement between applicator assembly 10 and substrate 34. As conventional in the art, coating compositions are supplied from reservoirs (not shown) under pressure using a conventional pump or other suitable well-known means such as a gas pressure system (not shown). The surfaces of passageways surfaces 18 and 26 are precision ground to ensure accurate control of the deposited coating thicknesses and uniformity. The coated substrate 34 is thereafter transported to any suitable drying device to dry the charge generating layer coating and charge transport layer coating.

Shown in FIG. 4, is a co-extrusion single slot coating applicator assembly 40. Applicator assembly 40 comprises a lower lip 42 and an upper lip 44. The upstream inner surface of lower lip 42 and upper lip 44 are spaced from a short common divider lip 46 to form flat narrow passageways 48 and 50, respectively. The flat narrow passageways 48 and 50 join to form a common passageway 52 that ultimately leads to exit slot 54. Passageway 48 leads from manifold 56 to common passageway 52. Similarly, flat narrow passageway 50 leads from manifold 58 to common passageway 52. A charge generating layer coating dispersion is fed into manifold 56 through feed pipe 60 and is extruded as a ribbon-like stream through passageway 48 and into common passageway 52. Similarly, a charge transport layer coating solution is fed into manifold 62 through feed pipe 60 and is extruded as a ribbon-like stream in through passageway 50 and into common passageway 52. The joined ribbon-like streams of liquid charge generating layer coating material and charge transport layer coating material leave exit slot 54 and deposit simultaneously on substrate 34. As with dual slot coating applicator assembly 10, end dams (not shown) are used to confine the coating compositions within the manifolds and passageways as the coating compositions travel from feed pipes to manifolds to the exit slot 54. The coated substrate 34 is thereafter transported to any suitable drying device to dry the charge generating layer coating and charge transport layer coating.

Illustrated in FIG. 5 is a multilayer slide die assembly 70 positioned adjacent to substrate 34. Multilayer slide die assembly 70 comprises an inclined upper land 72 adjacent to and downstream from a flat passageway 74 and an another inclined upper land 76 adjacent to and upstream from flat passageway 74 and adjacent to and downstream from flat passageway 74. Depending on the coating solution behavior, the inclined upper land 72 and inclined upper land 76 are aligned to generate maximum flow uniformity, therefore they may or may not to lie in substantially the same imaginary plane that slopes downwardly toward substrate 34. The angle of slope for inclined upper land 72 and inclined upper land 76 is dependent on the viscosity of the coating compositions. Thus, steeper angles of slope should be employed for higher viscosity coating compositions. If desired, a different slope may be used for inclined upper land 72 than for inclined upper land 76. A charge generating layer coating dispersion is fed into manifold 80 through feed pipe 82 and is extruded as a ribbon-like stream in through passageway 74 and out onto land 72 where the stream flows by gravity toward substrate 34. Substrate 34 is supported by rotatable roll 35. Similarly, a charge transport layer coating solution is fed into manifold 84 through feed pipe 86 and is extruded as a ribbon-like stream through passageway 74 and out onto land 76 where the stream flows by gravity onto the upper surface of the stream of the charge generating layer coating dispersion flowing toward substrate 34. The joined pair of ribbon-like streams of liquid charge generating layer coating material and charge transport layer coating material flow by gravity over land 72 and deposit simultaneously on substrate 34. A lip 88 located at the lower end of land 72 is positioned close to, but spaced from the surface of substrate 34 to prevent coating material from escaping downwardly through the narrow space between the substrate 34 and die assembly 70. As with slot coating and extrusion coating applicator assemblies described above, end dams (not shown) are used to confine the coating compositions within the manifolds and passageways as the coating compositions travel from feed pipes to manifolds to the inclined upper lands. The coated substrate 34 is thereafter transported to any suitable drying device to dry the charge generating layer coating and charge transport layer coating.

In FIG. 6 is a multilayer curtain die assembly 90 is shown which, although similar in construction to the multilayer slide die assembly 70 illustrated in FIG. 5, is positioned further away from substrate 34 to facilitate the formation of a falling curtain of the charge generating layer coating and charge transport layer coating prior to simultaneously depositing on the exposed surface of substrate 34. Multilayer curtain die assembly 90 comprises an inclined upper land 92 adjacent to and downstream from a flat passageway 94 and an another inclined upper land 96 adjacent to and upstream from flat passageway 94 and adjacent to and downstream from flat passageway 94. Depending on the coating solution behavior, the inclined upper land 92 and inclined upper land 96 are aligned to generate maximum flow uniformity, therefore they may or may not to lie in substantially the same imaginary plane that slopes downwardly toward substrate 34. The angle of slope for inclined upper land 92 and inclined upper land 96 is dependent on the viscosity of the coating compositions. Thus, steeper angles of slope should be employed for higher viscosity coating compositions. If desired, a different slope may be used for inclined upper land 72 than for inclined upper land 76. A charge generating layer coating dispersion is fed into manifold 100 through feed pipe 102 and is extruded as a ribbon-like stream in through passageway 94 and out onto land 92 where the stream flows by gravity toward substrate 34. Similarly, a charge transport layer coating solution is fed into manifold 104 through feed pipe 106 and is extruded as a ribbon-like stream through passageway 108 and out onto land 96 where the stream flows by gravity onto the upper surface of the stream of the charge generating layer coating dispersion flowing on land 92.

Substrate 34 is supported by rotatable roll 35. Preferably, the exposed upper surface of substrate 34 is aligned in a substantially horizontal attitude at the location where the falling curtain of the charge generating layer coating and charge transport layer coating deposit. Thus, the joined pair of ribbon-like streams of liquid charge generating layer coating material and charge transport layer coating material flow by gravity over land 92, form a falling curtain, and deposit simultaneously on substrate 34. A lip 108 located at the lower end of land 92 directs the falling film away from die assembly 90. As with the multilayer slide coating applicator assembly described above, end dams (not shown) are used to confine the coating compositions within the manifolds and passageways as the coating compositions travel from feed pipes to manifolds to the inclined upper lands. The coated substrate 34 is thereafter transported to any suitable drying device to dry the charge generating layer coating and charge transport layer coating.

The selection of the die passageway height (determines thickness of the ribbon of coating material as it traverses through the passageway), slope of an inclined land and the like generally depends upon factors such as the fluid viscosity, surface tension, flow rate, distance to the surface of the support member, relative movement between the die and the substrate, the thickness of the coating desired, and the like. Regardless of the technique employed, the flow rate and distance should be regulated to avoid splashing, dripping and puddling of the coating materials. For the type of die described in FIG. 3, generally, satisfactory results may be achieved with narrow passageway heights between about 127 micrometers and about 500 micrometers in the passageways for charge transport materials (top slot) and between about 100 micrometers and about 250 micrometers in the passageways for charge generator layers (bottom slot). The roof, sides and floor of the narrow die passageways should preferably be parallel and smooth to ensure achievement of laminar flow. The length of the narrow extrusion slot from the manifold to the outlet opening should be sufficient to ensure achievement of laminar flow and uniform coating solution distribution.

Relative speeds between an extrusion coating die assembly and the surface of the substrate up to about 200 feet per minute have been tested. However, it is believed that greater relative speeds may be utilized if desired. The relative speed should be controlled in accordance with the flow velocity of the ribbon-like streams of coating materials.

The flow velocities or flow rate per unit width of the narrow die passageways for the ribbon-like stream of coating materials for the extrusion dies die is determined by the targeted wet coating thickness as defined by:

$$\delta_{wet} = (Q/(W*V)) * 1 \times 10^{-6}$$

where:

| | |
|---|---|
| $\delta_{wet}$ | = wet coating thickness, micrometers |
| Q | = coating flow rate $cm^3$/sec. |
| W | = coating width, cm |
| V | = substrate velocity, cm/sec |

The coating flow rate should be sufficient to meet minimum conditions. At too low a flow rate it is not possible to form a continuous film result in ribbing defects or other defects associated with hydrodynamic instability.

The pressures utilized to extrude the coating compositions through the narrow die passageways depends upon the size of the passageway and viscosity of the coating composition.

Thus, the simultaneous application of a generator layer and a transport layer followed by the application of at least one additional transport layer provides a photoreceptor having dramatically improved dry thickness uniformity. Moreover, by simultaneously applying the generator layer with the first transport layer, the process of this invention leads to increased productivity and reduced costs over processes which apply a plurality of transport layers onto a generator layer. Another benefit of the process of this invention is the improved uniformity of photoreceptor devices with transport thicknesses in the 20 micrometer to 28 micrometer range. Surprisingly, for a photoreceptor having a charge transport layer thickness of about 29 micrometers after drying and an anti-curl backing having a thickness of about 14 micrometers and about 15 micrometers, the thermal expansion characteristics of the charge transport layer did not appear to change during drying so that there was less internal stress in the deposited dried charge transport layer.

PREFERRED EMBODIMENTS OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

CONTROL EXAMPLE I

A photoreceptor was prepared by forming coatings using conventional coating techniques on a substrate comprising vacuum deposited titanium layer on a polyethylene terephthalate film (Melinex®, available from ICI). The first coating was a siloxane blocking layer formed from hydrolyzed gamma aminopropyltriethoxysilane having a dried thickness of 0.005 micrometer (50 Angstroms). The second coating was an adhesive layer of polyester resin (49,000, available from E.I. duPont de Nemours & Co.) having a dried thickness of 0.005 micrometer (50 Angstroms). The next coating was a charge generator layer containing 3.7 percent by weight trigonal selenium particles, dispersed in a solution containing 2.9 percent by weight N,N'-diphenyl-N,N'-bis(3-methylphenyl)-(1,1'-biphenyl)- 4,4'-diamine, 8.7 percent by weight. Polyvinyl carbazole (PVK available from BASF), a film forming and 84.7 percent by weight solvent. The solvent is a 50/50 mixture by weight of tetrahydrofuran and toluene. This layer is coated to a mass density of trigonal selenium of 0.51 micrograms/sq. cm. As applied, the wet thickness of the coating is about 15.2 micrometers. After drying the thickness is about 1.45 micrometers for the trigonal selenium, PVK and N,N'-diphenyl-N,N'-bis(3-methylphenyl)-(1,1'-biphenyl)-4,4'-diamine combined.

A charge transport layer was formed on the charge generator layer by depositing a single coating with a slot coating die in a single coating pass, the coating containing a solution of 8.5 percent by weight N,N'-diphenyl-N,N'-bis(3-methylphenyl)-(1,1'-biphenyl)-4,4'-diamine, 8.5 percent by weight poly(4,4-isopropylidene-diphenylene) carbonate film forming binder (Makrolon, available from Bayer), and 83 percent by weight methylene chloride solvent. The viscosity of this solution was about 800 centipoises. The slot coating die had a slot height of 457 micrometers. The coating wet thickness was 186 microns. This coating was dried in a 5 zone drier with the following time/temperature profile:

TABLE 1

| Dryer Time/Temperature Profile - Transport Layer | | |
|---|---|---|
| Zone | Temperature, ° C. | Residence Time, sec. |
| 0 | 18 | 6 |
| 1 | 49 | 29 |
| 2 | 71 | 26 |
| 3 | 143 | 36 |
| 4 | 143 | 79 |

The result is a dries charge transport layer having a thickness of 29 micrometers and containing 50 percent by weight N,N'-diphenyl-N,N'-bis(3-methylphenyl)-(1,1' biphenyl)-4,4'-diamine and 50 percent by weight polycarbonate.

EXAMPLE II

A photoreceptor identical to the photoreceptor of Example I was prepared except that instead of forming the charge generating layer and charge transport layer using separate single layer slot coating passes, the charge generating layer and a first charge transport layer were simultaneously formed on the adhesive layer using a dual slot coating die essentially identical to FIG. 3. The lower slot dimension used for the charge generator layer was about 125 micrometers; the upper slot used for the charge transport layer was about 250 micrometers.

The simultaneously applied charge generator layer solution was formed as the bottom layer of the coating using the lower die slot of FIG. 3. The solution contained 12.8 percent by weight trigonal selenium particles, dispersed in a solution containing 4.9 percent by weight weight N,N'-diphenyl-N,N'-bis(3-methylphenyl)-(1,1'-biphenyl)-4,4' diamine, 9.7 percent by weight polyvinyl carbazole (PVK available from BASF), a film forming and 72.6 percent by weight solvent. The solvent is a 50/50 mixture by weight of tetrahydrofuran and toluene. This layer was coated to the same mass density of trigonal selenium (0.51 micrograms/sq. cm) as the control. As applied, the wet thickness of the coating is about 4 micrometers. After drying the thickness is about 0.6 micrometers for the trigonal selenium, PVK and N,N'-diphenyl-N,N'-bis(3-methylphenyl)-(1,1'-biphenyl)-4,4' diamine combined.

The simultaneously applied first transport layer was formed on top of the wet charge generator layer by depositing using the upper die slot of FIG. 3. The upper coating solution contained of 8.5 percent by weight N,N'-diphenyl-N,N'-bis(3-methylphenyl)-(1,1'-biphenyl)-4,4'-diamine, 8.5 percent by weight poly(4,4-isopropylidene-diphenylene) carbonate film forming binder (Makrolon, available from Bayer), and 83 percent by weight methylene chloride solvent. The viscosity of this solution was about 800 centipoise. The upper coating wet thickness was 54 micrometers. The dual coating was dried in a 5 zone drier with the time/temperature profile of Table 1. The upper layer dry thickness was about 10 micrometers.

Next, a second charge transport layer was formed by single layer slot coating over the previously dried layers. Identical charge transport coating solution compositions were used for both the multicoating and singular coating. The slot die for the singular slot coating of the second transport layer had a slot height of 250 micrometers. Sufficient transport solution was applied in the second layer (19 micrometers) to bring the combined total transport layers from the first multicoating and the second singular coating to 29 micrometers after drying. The wet thickness of the second singular layer was about 103 micrometers. The second charge transport coating was also dried according to Table 1. The first and second charge transport layers as well as the combination contained 50 percent by weight N,N'-diphenyl-N,N'-bis(3-methylphenyl)-(1,1' biphenyl)-4,4'-diamine and 50 percent by weight polycarbonate.

Interference images were generated by illuminating the charge transport layers of the photoreceptors of Examples I and II with monochromatic light. FIGS. 1 and 2 are essentially topographical maps of the transport layer thickness. Each line (fringe) in FIGS. 1 and 2, represent a 0.3 micrometer change in thickness. By counting the number of closed loop fringes in the pictures over a defined area, a measurement of the thickness uniformity can be made. Overall, the 29 micrometer thick charge transport layer of Example I coating had a high frequency thickness variation of about 0.8–1.0 micrometer per square cm. The 29 micrometer thick charge transport layer of Example II (combined thickness of the first and second charge transport layers after drying) had a high frequency thickness variation of about 0.1 micrometer per square cm. Thus, the thickness variation of the charge transport layer of Example I was about 700 to 900 percent greater than the thickness variation of the charge transport layer of Example II.

In addition the width in each fringe is proportional to the steepness of the thickness change. Therefore numerous sharply defined fringes are analogous to a high, jagged mountain range. Widely spaced diffuse fringes (that appear poorly focused) are analogous to low, softly rolling hills.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for fabricating electrophotographic imaging members comprising providing an imaging member comprising a substrate with an exposed surface, simultaneously applying, to the exposed surface, a dual layer coating of a dispersion comprising photoconductive particles, a film forming binder and a predetermined amount of a solvent for the binder to the exposed surface to form a charge generating layer having a thickness between about 0.1 micrometer and about 10 micrometers in the dried state and a first solution comprising a charge transporting small molecule and film forming binder to the charge generating layer having a thickness between 4 micrometer and 20 micrometer in the dried state and then applying a singular coating of at least a second solution having a composition substantially identical to the first solution to the exposed surface of the first charge transporting layer to form at least a second continuous charge transporting layer, the at least second charge transport layer having a thickness in a dried state less than about 20 micrometers in the dried state, the at least second charge transport layer, and any subsequently applied solution having a composition substantially identical to the first solution.

2. A process according to claim 1 wherein the second continuous charge transporting layer is the only charge transporting layer applied to the first charge transport layer and the second charge transporting layer has a thickness in a dried state of greater than about 13 micrometers and less than about 20 micrometers.

3. A process according to claim 1 wherein the first solution has a solids concentration greater than about 13 percent total solids based on the total weight of the coating solution.

4. A process according to claim 1 wherein the first solution has a viscosity greater than about 400 centipoises.

5. A process according to claim 1 wherein a total of three transport layers are formed and the first, simultaneously applied coating has a layer thickness of between 4 micrometers and 20 micrometers in the dried state and then sequentially applying two singular transport layers each layer having a thickness in the dried state of greater than about 13 micrometers and less than about 20 micrometers and the total combined thickness of all charge transport layers in the dried state is greater than about 30 micrometers and less than about 60 micrometers.

6. A process according to claim 1 wherein a total of four transport layers are formed and the first, simultaneously applied coating has a layer thickness of between 4 micrometers and 20 micrometers in the dried state and then sequentially applying three singular transport layers each layer having a thickness in the dried state of greater than about 13 micrometers and less than about 20 micrometers and the total combined thickness of all charge transport layers in the dried state is greater than about 43 micrometers and less than about 80 micrometers.

7. A process according to claim 1 wherein the first solution has a viscosity between about 400 centipoises and about 1500 centipoises.

8. A process according to claim 1 including applying the first solution by dual slot, slide, or curtain coating.

9. A process according to claim 1 including applying the second solution by slot coating.

* * * * *